US010770247B1

(12) United States Patent
Wu

(10) Patent No.: US 10,770,247 B1
(45) Date of Patent: Sep. 8, 2020

(54) VARISTOR TYPE MULTI-DIRECTIONAL INPUT DEVICE

(71) Applicant: Dongguan City Kaihua Electronics Co., Ltd, Dongguan, Guangdong (CN)

(72) Inventor: FuXi Wu, Guangdong (CN)

(73) Assignee: Dongguan City Kaihua Electronics Co., Ltd, Dongguan (CN)

( * ) Notice: Subject to any disclaimer, the term of this patent is extended or adjusted under 35 U.S.C. 154(b) by 0 days.

(21) Appl. No.: 16/697,206

(22) Filed: Nov. 27, 2019

(51) Int. Cl.

| | |
|---|---|
| ***H01H 23/14*** | (2006.01) |
| ***H01C 7/10*** | (2006.01) |
| ***H01H 23/16*** | (2006.01) |
| ***H01H 23/08*** | (2006.01) |
| ***H01H 23/04*** | (2006.01) |

(52) U.S. Cl.
CPC ..... *H01H 23/143* (2013.01); *H01C 7/1013* (2013.01); *H01H 23/04* (2013.01); *H01H 23/08* (2013.01); *H01H 23/162* (2013.01)

(58) Field of Classification Search
CPC .... H01C 7/1013; H01C 10/12; H01H 23/143; H01H 23/08; H01H 23/162
See application file for complete search history.

(56) References Cited

U.S. PATENT DOCUMENTS 6,059,660 A * 5/2000 Takada ..... G05G 9/047 273/148 B
6,078,247 A * 6/2000 Shimomura ..... H01C 10/16 338/131
6,150,919 A * 11/2000 Shimomura ..... G05G 9/047 200/6 A
6,313,731 B1 * 11/2001 Vance ..... H01H 13/70 200/5 A
6,445,377 B1 * 9/2002 Shimomura ..... G05G 9/047 345/161
6,580,418 B1 * 6/2003 Grome ..... A63F 13/22 345/161
6,654,005 B2 * 11/2003 Wang ..... G05G 9/04796 200/6 A
6,897,391 B2 * 5/2005 Gavalda ..... G05G 9/02 200/17 R
7,199,314 B2 * 4/2007 Huang ..... G05G 9/04796 200/6 A
9,627,161 B2 * 4/2017 Yamamoto ..... H01H 25/041
2018/0190452 A1 * 7/2018 Wu ..... G05G 9/047

* cited by examiner

*Primary Examiner* — Kyung S Lee

(57) ABSTRACT

A varistor type multi-directional input device, including an upper cover, a base, a rocker assembly, a reset assembly, an electrical component, a switch elastic piece and a terminal assembly. The conductive elastic piece of the electrical component is mounted in a cavity surrounded by the upper cover, the base and the varistor. The rocking bar is operated to swing the eccentric wheel of the upper rocker arm or the lower rocker arm, and the surface pressure of the varistor is different due to the different deformation of elastic piece caused by the change of the height of the eccentric wheel in the axial direction, so that the varistor outputs different resistance values to achieve control of the screen cursor. The present disclosure is provided with a rocker arm seat which is matched with the upper rocker arm and the lower rocker arm.

10 Claims, 10 Drawing Sheets

VARISTOR TYPE MULTI-DIRECTIONAL INPUT DEVICE

TECHNICAL FIELD

The present disclosure relates to the field of multi-directional input devices, and more particularly to a varistor type multi-directional input device.

BACKGROUND

With the improvement of living standards, leisure activities of people are increasingly rich and colorful. The electronic game machines that integrate leisure and entertainment, develop intelligence, cultivate emotional intelligence, and even exercise and fitness are more and more popular. As an important component of electronic game machine, the game rocker switch is an important part that people experiences video games.

A rocker and a switch are disclosed in the patent CN1877509, which are composed of a base, a cover, a rod, a universal assembly, a plurality of flexible films or components and a switch elastic piece. The cover has a top and a bottom. The cover has a plurality of pins and projections, and the projections extend from the bottom. The cover is mounted on the base. An opening allows the rod to pass through the cover. The cover has a plurality of walls. A plurality of slots are formed in the wall portions. A pair of semi-circular cavities are disposed in the cover. The semi-circular cavities have an inner surface. The flexible films are mounted on the inner surface of the semi-circular cavities.

In the rocker switch, the rod indirectly controls a flexible film provided with a resistor to generate an electrical signal indicating the position of the rod, and when the rod moves, the finger portion of the contactor moves along the resistive track of the flexible film and the conductor track to change the terminal voltage. However, the structure of the rod in the patent is complicated, which results in complicated assembly of the rocker switch, time-consuming and laborious, high cost, and requires to be moved relatively to realize the change of the terminal voltage value, and the operation is insensitive. With the development of science and technology, a miniaturized multi-direction input device with simplified structure is urgently needed.

SUMMARY

To solve the above problems, a varistor type multi-directional input device is provided by the present disclosure, with labor-saving operation, smooth use, good finger pressure touch, simple structure and easy installation.

The technical solution of the present disclosure is that a varistor type multi-directional input device, comprising a base an upper cover, wherein an opening is provided on an upper surface of the upper cover, and the upper cover is disposed on the base to form a central cavity, a rocker assembly, wherein the rocker assembly is mounted in the central cavity, comprising a rocking bar, an upper rocker arm, and a lower rocker arm; the upper rocker arm and the lower rocker arm are arranged in an upper and lower cross; the upper rocker arm is in a shape of an arch, the upper rocker arm comprises a first convex portion formed by a central, a first shaft end and a second shaft end disposed at two sides of the first convex portion, and a first through hole at a center of the first convex portion; the lower rocker arm comprises a second convex portion formed by a central upward convex, a third shaft end and a fourth shaft end disposed at two sides of the second convex portion, and a second through hole at a center of the second convex portion; the upper rocker arm and the lower rocker arms are respectively provided with an eccentric wheel; the rocking bar comprises an upper end, and a lower end, the lower end is riveted with the lower rocker arm, protrudes from the second through hole of the lower rocker arm and passes through the first through hole of the upper rocker arm, extends to pass through the opening of the upper cover, and the eccentric wheels of the upper rocker arm and the lower rocker arm are driven by the rocking bar to swing;

a reset assembly, wherein the reset assembly is mounted under the rocker assembly for resetting the rocker assembly after the rocker assembly is pressed;

an electrical component, wherein the electrical component controls a change in resistance, and is configured for converting a motion signal of the rocker assembly into an electrical signal; the electrical component comprises a varistor, an on-off switch, a conductive elastic piece; the on-off switch comprises a switch guide core and a conductive elastic piece; and a terminal assembly configured to output the electrical signal, comprising a varistor terminal, and a switch terminal, wherein the varistor terminal is mounted on an outside of the varistor, and the switch terminal is mounted on an outside of the switch guide core; the switch guide core is pressed by the eccentric wheel of the upper rocker arm or the lower rocker arm when the rocking bar is pressed, to connect and disconnect the conductive elastic piece and the switch terminal.

Further improvements to the above technical solution are as follows: the upper rocker arm and the lower rocker arm are arranged in a cross shape.

Further improvements to the above technical solution are as follows: the varistor is a thin film resistor.

Further improvements to the above technical solution are as follows: the rocker assembly comprises a rocker arm seat; the rocker arm seat is provided with a rocker arm seat receiving groove corresponding to the second shaft end of the upper rocker arm and the fourth shaft end of the lower rocker arm; the base is provided with a base receiving groove corresponding to the first shaft end of the upper rocker arm and the third shaft end of the lower rocker arm; the rocker arm seat and the base are arranged in a staggered manner, and a first chamber of the rocking bar and the reset assembly is formed in the middle, and the rocker arm seat and the base are respectively provided with a plurality of second chambers matching with the eccentric wheels; the switch guide core and the conductive elastic piece are placed in the second chamber, and an end of the rocking bar is an inverted frustum cone.

Further improvements to the above technical solution are as follows: the base is provided with a second base receiving groove corresponding to the first shaft end and the second shaft end of the upper rocker arm and the third shaft end and the fourth shaft end of the lower rocker arm; a first base receiving chamber matching with a lower end portion of the lower rocker arm and a second base receiving chamber matching with the eccentric wheels of the upper locker arm and lower rocker arm are provided at a center of the base; the switch guide core and the conductive elastic piece is placed in the first base receiving chamber, the lower end of the lower rocker arm is spherical, the lower rocker arm is in contact with the reset assembly; and an elastic member is placed in the second base receiving chamber, a lower part of the second base receiving chamber is in contact with the varistor.

Further improvements to the above technical solution are as follows: the base is provided with a switch terminal, a lower bottom plate is disposed under the base, and the varistor terminal is arranged on the lower bottom plate; the lower bottom plate is snapped or screwed or riveted or pin fastened to the base.

Further improvements to the above technical solution are as follows: the eccentric wheels are a cam blocks integrally formed with the upper rocker arm and the lower rocker arm.

Further improvements to the above technical solution are as follows: the reset assembly comprises a reset ring and a spring.

Further improvements to the above technical solution are as follows: the elastic member is a reed, and the reed is disposed between the eccentric wheels and the varistor.

Further improvements to the above technical solution are as follows: the elastic member is a combination of a trigger piece and a spring.

The advantageous effects of the present disclosure are shown as below:

1. The pressure is transferred to the conductive elastic piece through the eccentric wheels on the rocker arms, and the deformation of the conductive elastic piece is changed due to the change of the height of the eccentric wheel in the axial direction, so that the surface of the varistor is subjected to different pressures, thus the resistance value output of the varistor is different. Thereby achieving multi-directional rocker operation, and diversified cursor brightness display, which improves user experience;

2. The rocker arm seat or the base structure is matched with the upper rocker arm and the lower rocker arm, so that the rocker structure is simple, the assembly is easy, and the finger pressure feel is good.

3. The lower rocker arm provided with the spherical end portion simplifies the rocker structure.

DESCRIPTION OF REFERENCE NUMERALS IS AS BELOW

Figure 1:
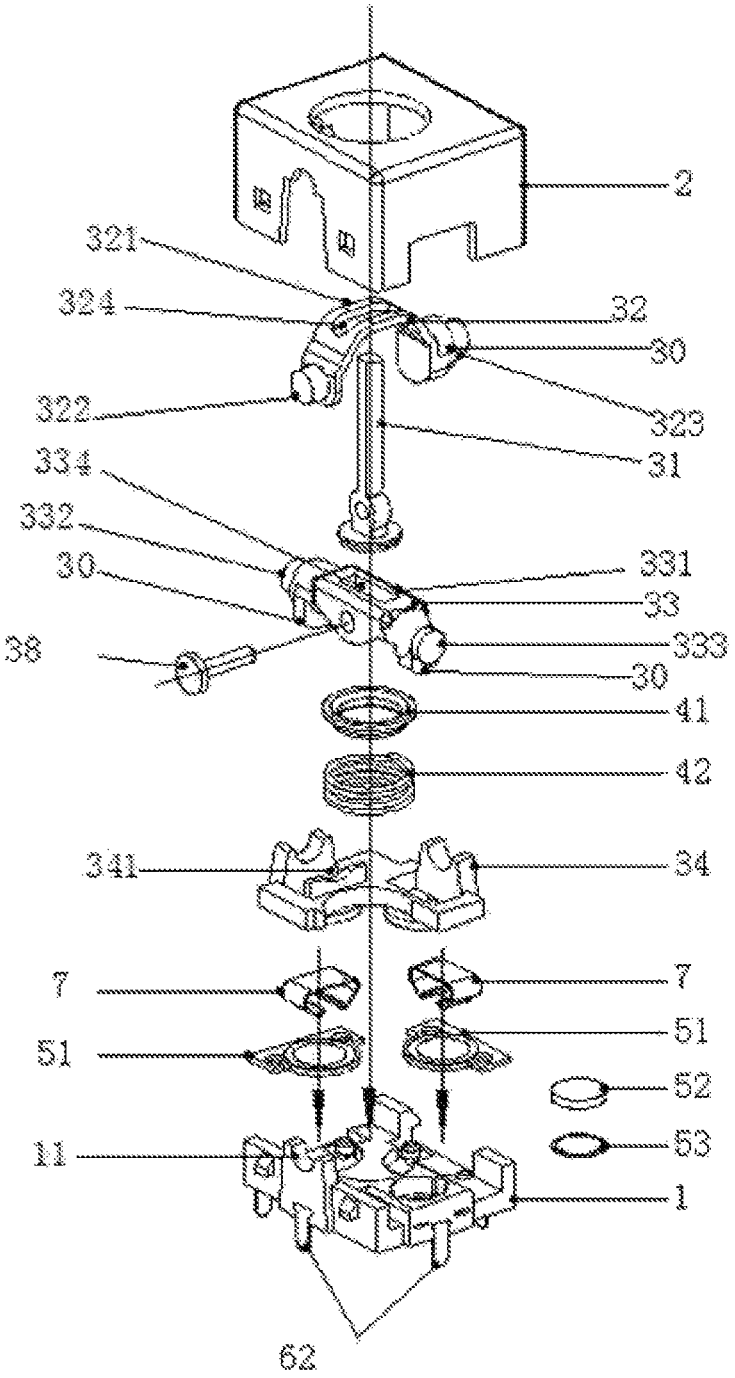
FIG. 1 is an exploded view of a first embodiment of the present disclosure.
Figure 2:
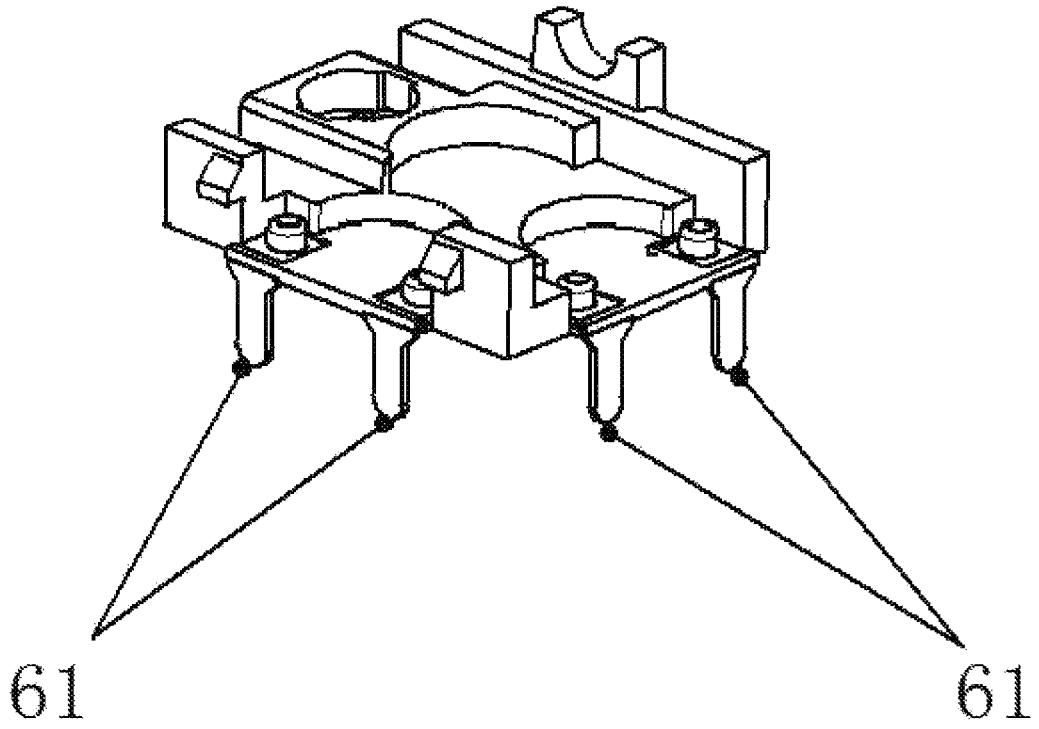
FIG. 2 is a schematic view of a base according to the first embodiment of the present disclosure.

1 base, 11 first base receiving groove, 12 second base receiving groove, 13 first base receiving chamber, 14 second base receiving chamber, 2 upper cover, 3 rocker assembly, 30 eccentric wheel, 301 eccentric wheel axis, 31 rocking bar, 311 upper end, 312 lower end, 32 upper rocker arm, 320 upper rocker arm axis, 321 first convex portion, 322 first shaft end, 323 second shaft end, 324 first through hole, 33 lower rocker arm, 330 lower rocker arm axis, 331 second convex portion, 332 third shaft end, 333 fourth shaft end, 334 second through hole, 34 rocker arm seat, 341 first rocker seat receiving groove, 35 rivet, 41 reset ring, 42 spring, 5 electrical components, 51 first varistor, 511 first varistor positioning hole, 52 second varistor, 521 second varistor positioning hole, 53 switch guide core, 54 conductive elastic piece, 6 terminal assembly, 61 varistor terminal, 62 switch terminal, 63 lower bottom plate, 7 reed, 71 reed upper surface, d distance between the upper/lower rocker axis and eccentric wheel axis.

DETAILED DESCRIPTION OF THE EMBODIMENTS

The present disclosure will be further illustrated with the accompanying drawings as below.

Embodiment One

As shown in FIGS. 1-6, FIGS. 1-6 are perspective view, exploded view, exploded view, and cross-sectional view of the first embodiment of the present disclosure, respectively. A varistor type multi-directional input device includes a base 1; a upper cover 2, wherein an opening is provided on an upper surface of the upper cover 2, and the upper cover 2 is disposed on the base 1 to form a central cavity. A rocker assembly 3 is mounted in the central cavity, including a rocking bar 31, an upper rocker arm 32, and a lower rocker arm 33. The upper rocker arm 32 and the lower rocker arm 33 are arranged in an upper and lower cross. The upper rocker arm 32 is in a shape of an arch, the upper rocker arm 32 includes a first convex portion 321 formed by a central upward convex, a first shaft end 322 and a second shaft end 323 disposed at two sides of the first convex portion 321, and a first through hole 324 at a center of the first convex portion 321. The lower rocker arm 33 includes a second convex portion 331 formed by a central upward convex, a third shaft end 332 and a fourth shaft end 333 disposed at two sides of the second convex portion 331, and a second through hole 334 at a center of the second convex portion 331. The upper rocker arm 32 and the lower rocker arm 33 are respectively provided with an eccentric wheel 30. The rocking bar 31 includes an upper end 311 and a lower end 312, and the lower end 312 is riveted with the lower rocker arm 33, protrudes from the second through hole 334 of the lower rocker arm 33 and passes through the first through hole 324 of the upper rocker arm 32, extends to pass through the opening of the upper cover 2, and the eccentric wheels 30 of the upper rocker arm 32 and the lower rocker arm 33 are driven by the rocking bar 31 to swing.

A reset assembly 4 is mounted under the rocker assembly 3 for resetting after the rocker assembly 3 is pressed.

An electrical component 5 is electrically connected to the rocker assembly 3, to configure for converting a motion signal of the rocker assembly 3 into an electrical signal. The electrical component 5 includes a varistor 51, a switch guide core 52, a conductive elastic piece 53. The eccentric wheel 30 is in contact with the varistor 51, the switch guide core 52, and the conductive elastic piece 53 through the elastic member.

The terminal assembly 6 is configured to output an electrical signal, including a varistor terminal 61, and a switch terminal 62, wherein the varistor terminal 61 is mounted on an outside of the varistor 51. The varistor 51 is in contact with the switch guide core 52 via the rocker assembly 3, and the conductive elastic piece 53 is electrically connected to the varistor terminal 61. The switch terminal 62 is mounted on an outside of the switch guide core 52.

Figure 4:
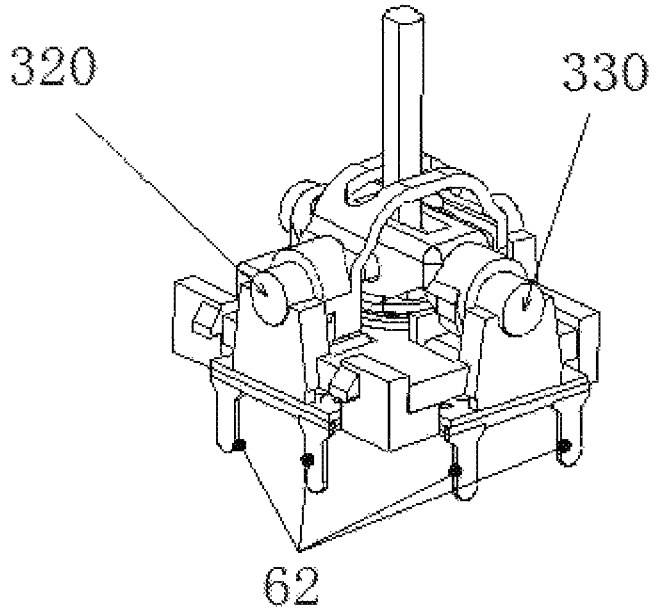
FIG. 4 is a schematic view showing the assembly of the first embodiment of the present disclosure.

In this embodiment, as shown in FIG. 4, the upper rocker arm 32 and the lower rocker arm 33 are arranged in a cross shape, so that the rocking bar can flexibly realize the shaking in the directions of X-axis and Y-axis.

In this embodiment, the varistor 51 is a thin film resistor, so that a lighter rocker switch is realized.

In the first embodiment, the rocker assembly 3 includes a rocker arm seat 34. The rocker arm seat 34 is provided with a rocker arm seat receiving groove 341 corresponding to the second shaft end 323 of the upper rocker arm 32 and the fourth shaft end 333 of the lower rocker arm 33. The base 1 is provided with a base receiving groove 11 corresponding to the first shaft end 322 of the upper rocker arm 32 and the third shaft end 332 of the lower rocker arm 33. The rocker arm seat 34 and the base 1 are arranged in a staggered manner, and a first chamber 35 of the rocking bar 31 and the reset assembly 4 is formed in the middle, and the rocker arm seat 34 and the base 1 are respectively provided with a plurality of second chambers 36 matching with the eccentric wheels 30. The switch guide core 52 and the conductive elastic piece 53 are placed in the second chamber 36, and an end of the rocking bar 31 is an inverted frustum cone to perform a locking function, so that the rocking bar 31 will not pull away from the upper rocker arm 32 and the lower rocker arm 33 when the user operators the rocking bar, as shown in FIG. 3.

Figure 3:
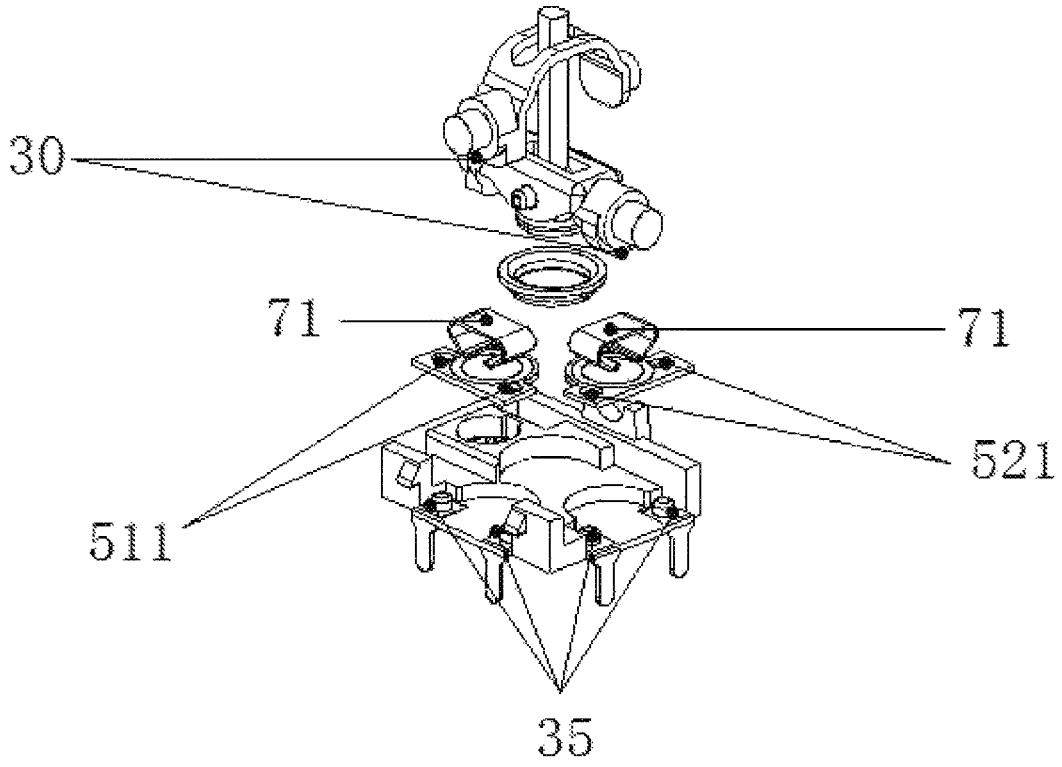
FIG. 3 is an exploded view according to the first embodiment of the present disclosure.

Working process: as shown in FIGS. 1-4: the user presses the rocking bar 31, the pressing force is transferred to the switch guide core 52 through the rocking bar 31, so that the conductive elastic piece 53 is deformed, and then the switch terminal 62 is turned on. And when the eccentric wheel 30 on the upper rocker arm 32 and the lower rocker arm 33 is rotated driven by the operation of the rocking bar 31, so that different positions of the eccentric wheel 30 are in contact with the elastic member at different heights, so as to apply different pressures to the varistor 51, thereby different resistance value of the varistor 51 can be realized. Specifically, the elastic member may be a reed, or a combination of the trigger piece and the spring. As shown in FIG. 3, the eccentric wheel 30 abuts against the upper surface 71 of the reed 7, and the eccentric wheel 30 may be buffered the pressure applied directly to the varistor 51 to perform a protective function. In this embodiment, the first varistor 51 is provided with a first varistor positioning hole 511 for riveting with the base to realize electrical connection of the varistor terminal. The second varistor 52 is provided with a second varistor positioning hole 521 for riveting with the base to realize electrical connection of the varistor terminal.

Figure 5:
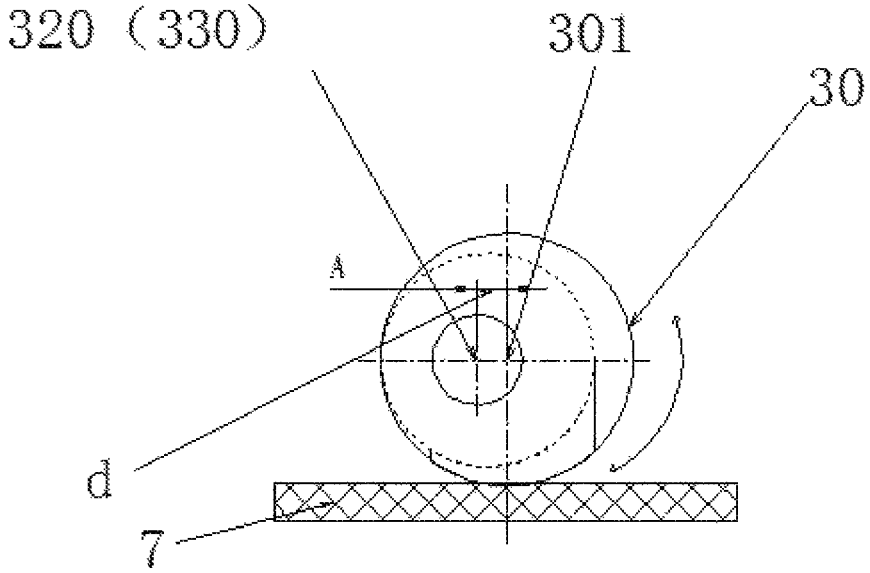
FIG. 5 is a schematic view showing the use state of the rocking bar of the present disclosure.
Figure 6:
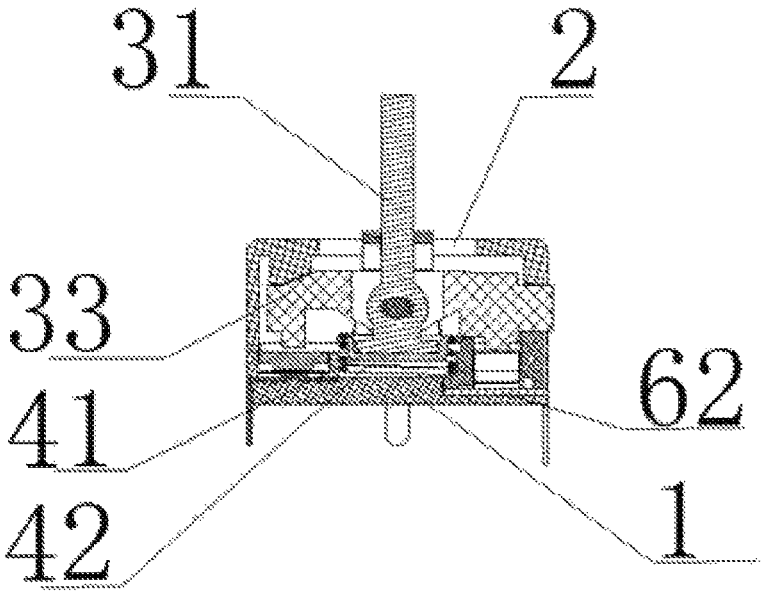
FIG. 6 is a cross-sectional view showing the first embodiment of the present disclosure.
Figure 7:
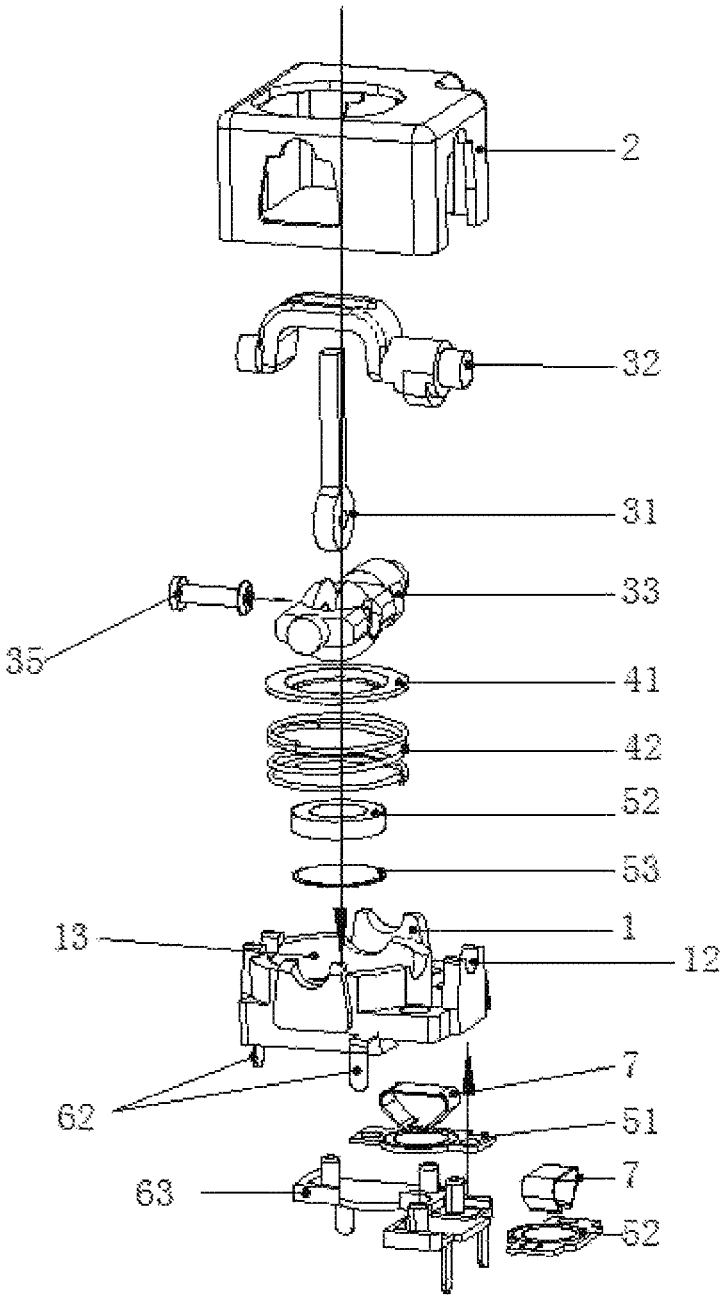
FIG. 7 is an exploded view of a second embodiment of the present disclosure.
Figure 8:
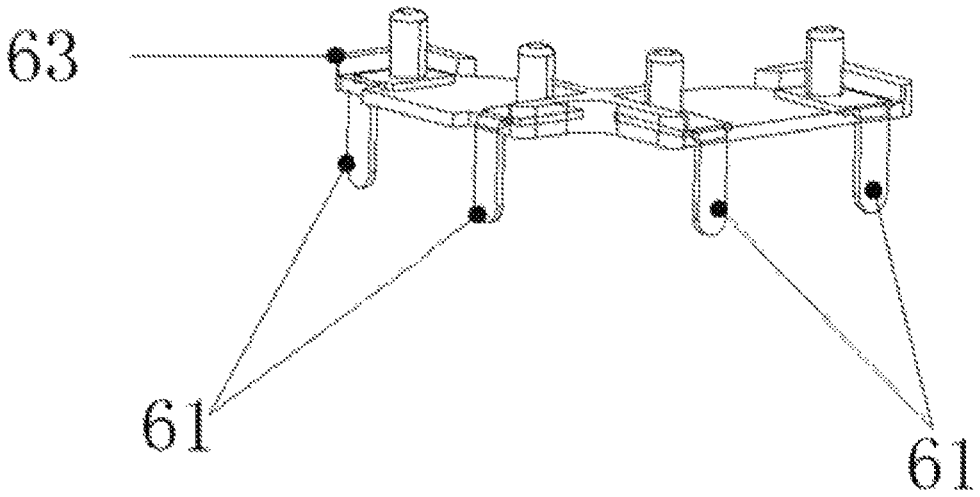
FIG. 8 is a schematic view showing a lower bottom plate according to the second embodiment of the present disclosure.
Figure 9:
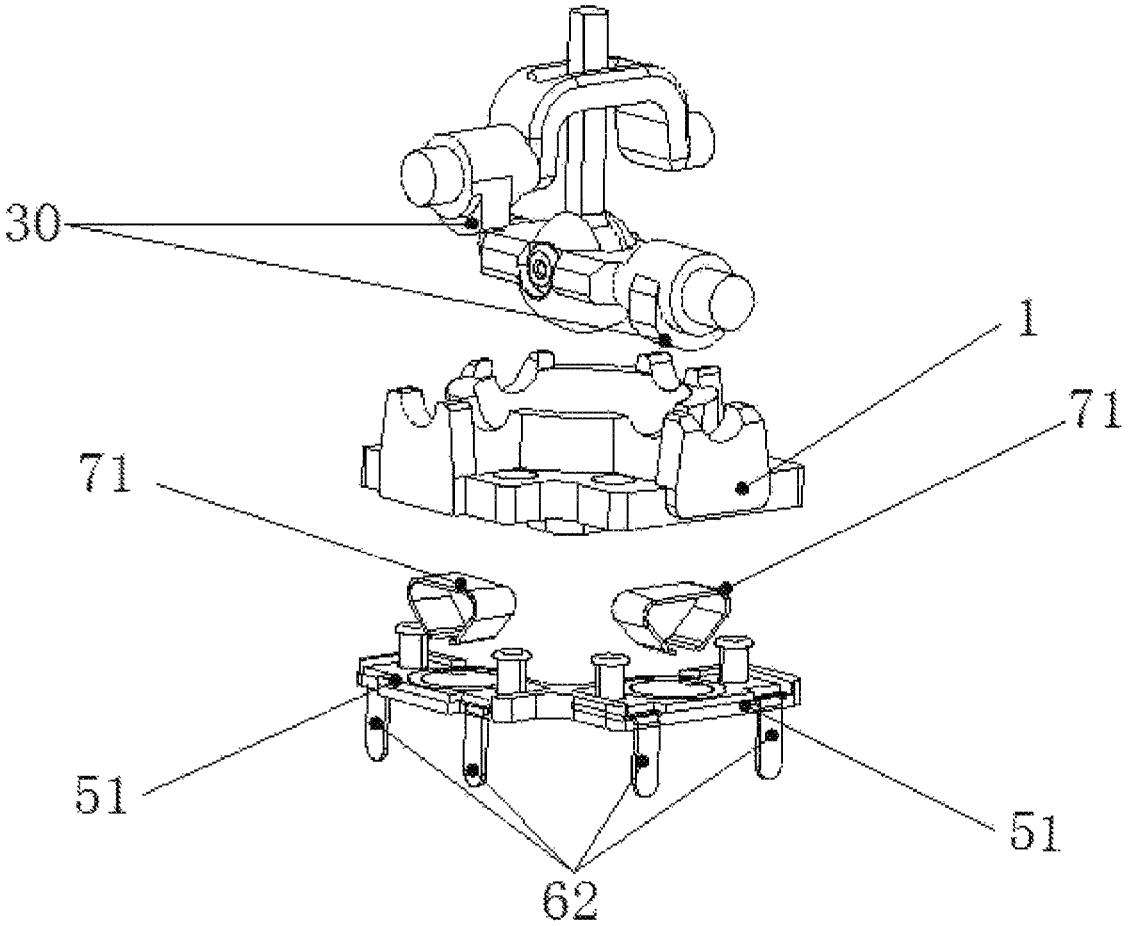
FIG. 9 is an exploded view according to the second embodiment of the present disclosure.
Figure 10:
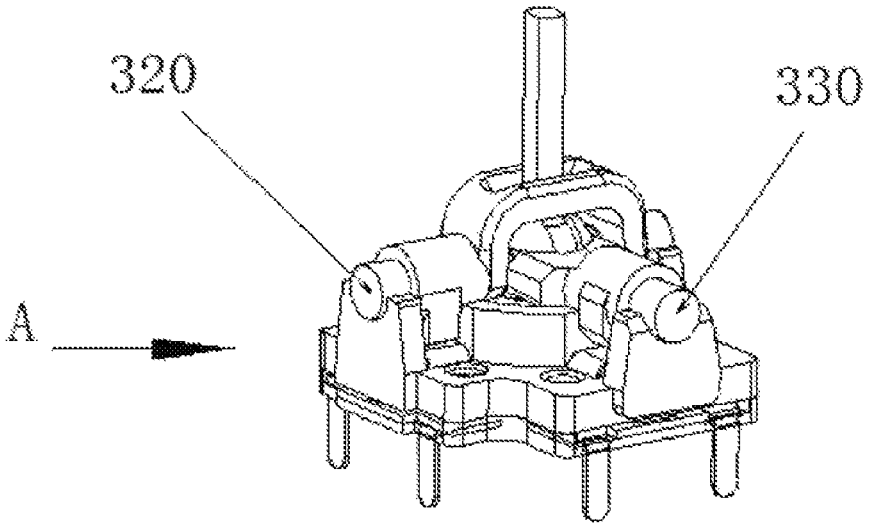
FIG. 10 is a schematic view showing the assembly of the second embodiment of the present disclosure.
Figure 11:
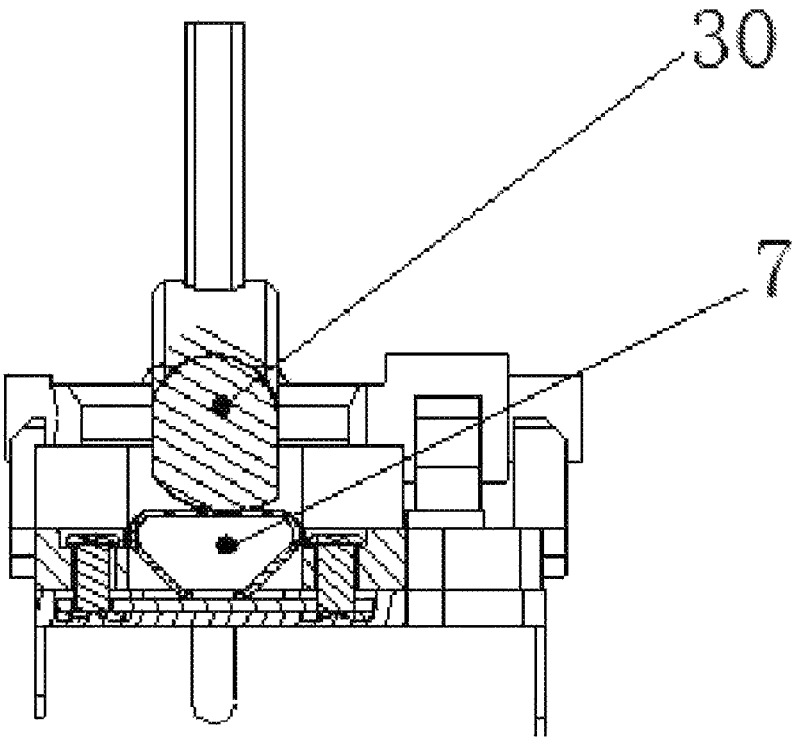
FIG. 11 is a lateral cross-sectional view A of the second embodiment of the present disclosure.
Figure 12:
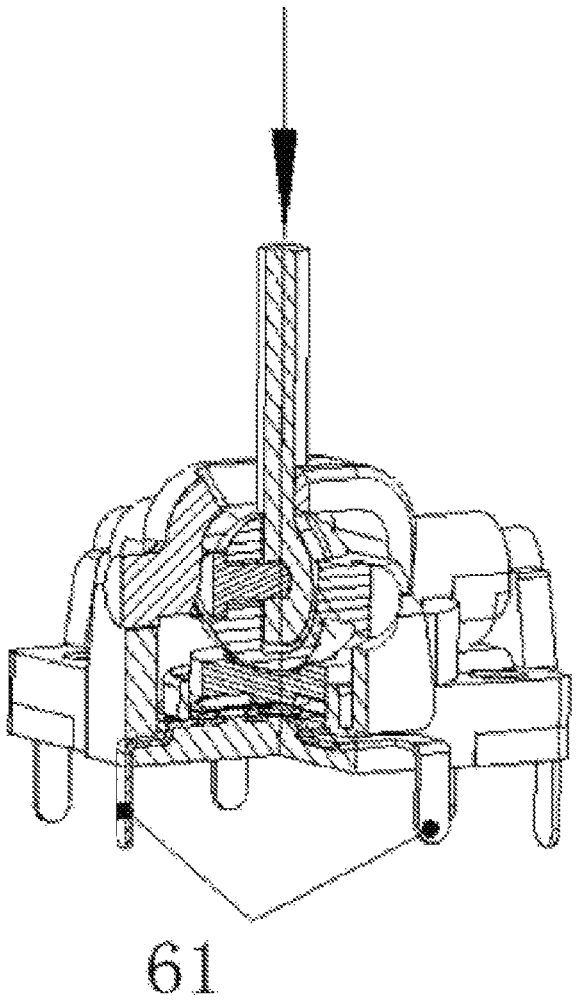
FIG. 12 is a cross-sectional view showing the second embodiment of the present disclosure in use state.
Figure 13:
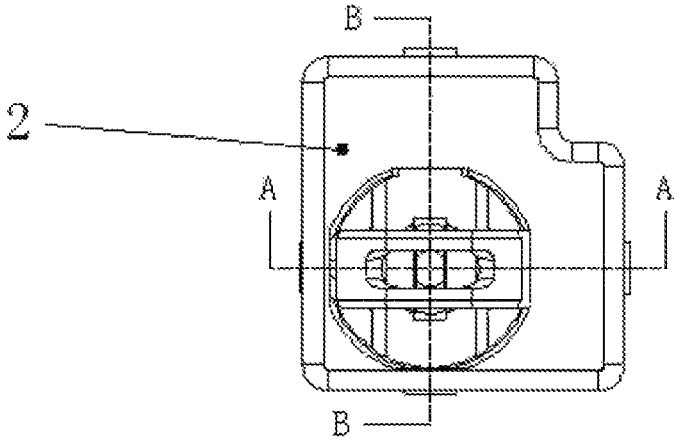
FIG. 13 is a top view of the second embodiment of the present disclosure.
Figure 14:
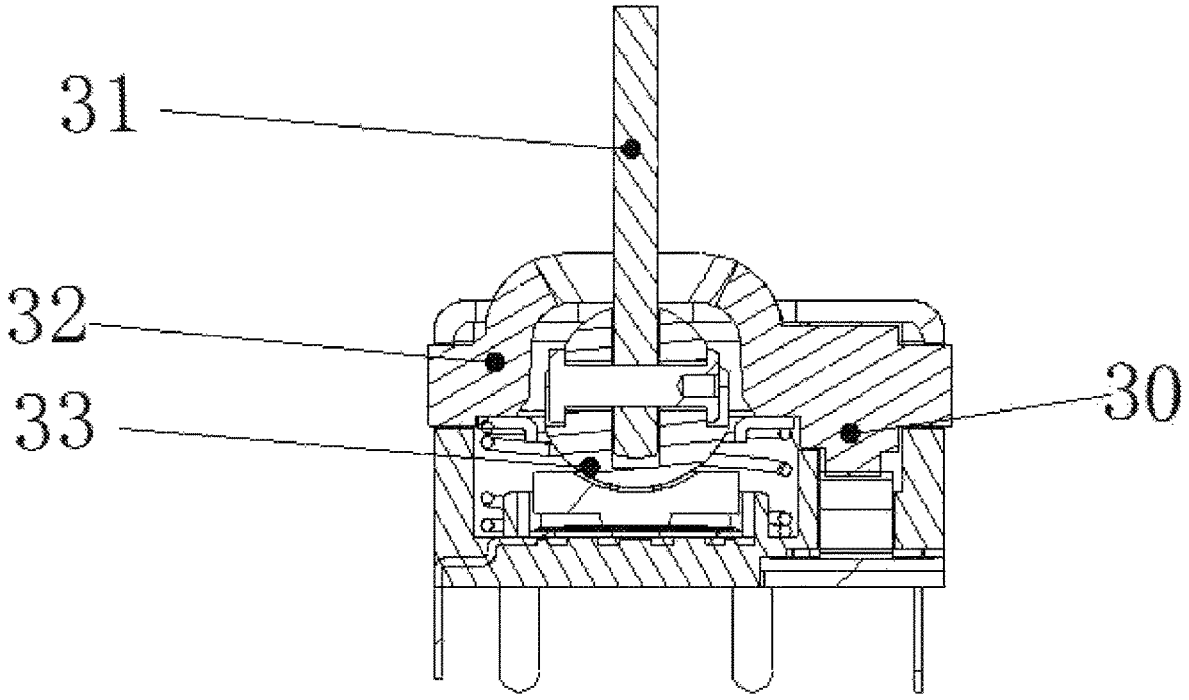
FIG. 14 is a cross-sectional view taken along the line B-B of the second embodiment of the present disclosure.
Figure 15:
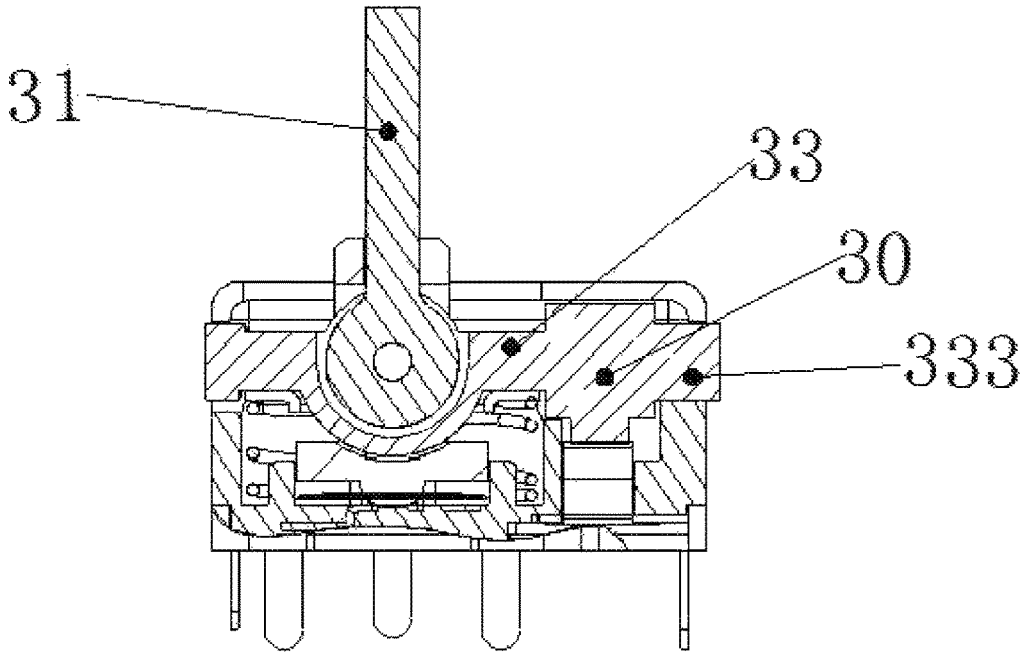
FIG. 15 is a cross-sectional view taken along the line A-A of the second embodiment of the present disclosure.
Figure 16:
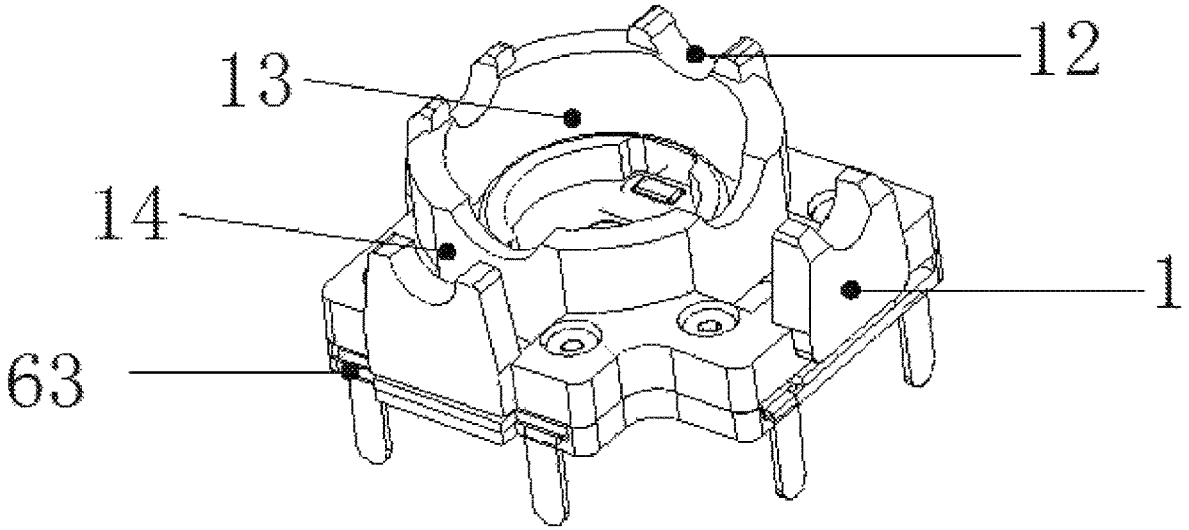
FIG. 16 is a schematic view of a base according to the second embodiment of the present disclosure.
Figure 17:
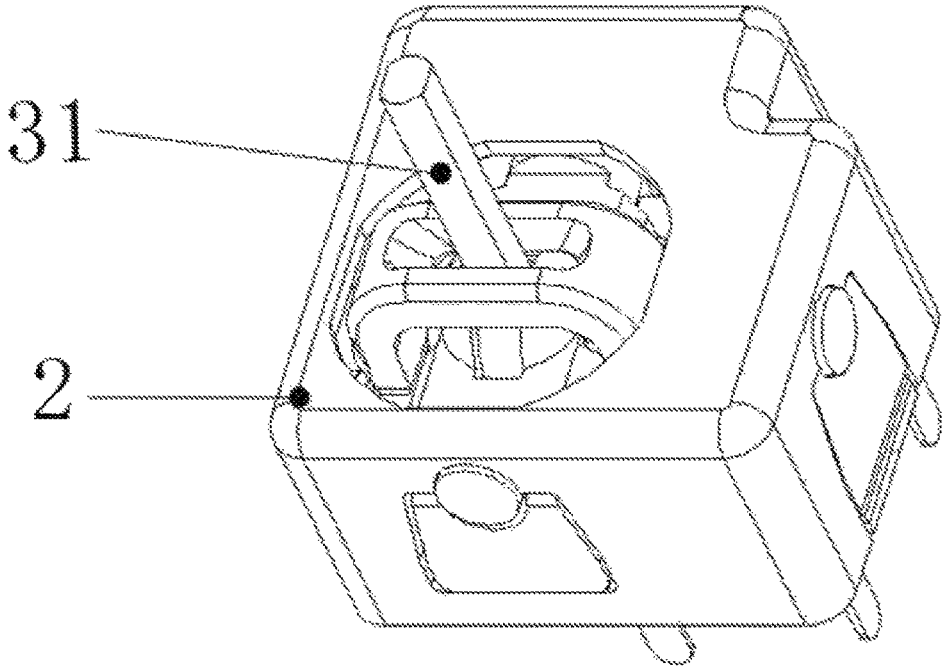
FIG. 17 is a perspective view of the second embodiment of the present disclosure.

As shown in FIG. 5, when the rocking bar 31 is rotated by the user, the eccentric wheel 320 on the upper rocker arm and the eccentric wheel 330 on the lower rocker arm are rotated to the left, the reed 7 is subjected to a small pressure and the resistance value of the varistor is large. And the reed 7 is subjected to a large pressure and the resistance value of the varistor is small when it is rotated to the right. d is the distance between the upper/lower rocker arm axis and the eccentric wheel axis 301, and d varies with the rocking of the rocking bar 31.

Embodiment Two

As shown in FIGS. 7-17, the base 1 is provided with a second base receiving groove 12 corresponding to the first shaft end 322 and the second shaft end 323 of the upper rocker arm 32 and the third shaft end 332 and the fourth shaft end 333 of the lower rocker arm 33. A first base receiving chamber 13 matching with a lower end portion of the lower rocker arm, and a second base receiving chamber 14 matching with the eccentric wheels 30 of the upper locker arm 32 are provided at a center of the base. The switch guide core 52 and the conductive elastic piece 53 are placed in the first base receiving chamber 13, the lower end of the lower rocker arm 33 is spherical, the lower rocker arm 33 is in contact with the reset assembly 4. and an elastic member is placed in the second base receiving chamber 14, a lower part of the second base receiving chamber is in contact with the varistor 51.

In this embodiment, the base 1 is provided with the switch terminal 62, a lower bottom plate 63 is disposed under the base 1, and the varistor terminal 61 is arranged on the lower bottom plate 63. The lower bottom plate 63 is snapped or screwed or riveted or pin fastened to the base 1.

In this embodiment, the eccentric wheels 30 are cam blocks integrally formed with the upper rocker arm 32 and the lower rocker arm 33, which simplifies the crank mechanism setting in the existing technology.

In this embodiment, the reset assembly 4 includes a reset ring 41 and a spring 42.

In this embodiment, the reed is disposed between the eccentric wheels 30 and the varistor 51.

In this embodiment, a trigger piece and a spring 42 are disposed in sequence between the eccentric wheel 30 and the varistor 51 from top to bottom.

In the above embodiment, the on-off switch is optional which can meet the product requirements.

Working process: as shown in FIGS. 5-17: the user presses the rocking bar 31 and the pressure is transferred to the switch guide core 52 located inside the first base receiving chamber 13 in the center of the base 1 through the lower rocker arm 33 having a spherical shape at the lower end. And then, the conductive elastic piece 53 is deformed, the switch terminal 62 is electrically connected, and when the eccentric wheels 30 on the upper rocker arm 32 and the lower rocker arm 33 are rotated driven by the operation of rocking bar 31, so that different positions of the eccentric wheel 30 are in contact with the elastic member provided in the second receiving chamber 14 in the base 1 at different heights, so as to apply different pressures to the varistor 51, thereby different resistance value of the varistor 51 can be realized, which are output through the varistor terminal 61 provided on the lower bottom plate 63, so that diversified cursor display brightness is achieved. Specifically, the elastic member may be a reed, or a combination of the trigger piece and the spring, which can buffer the pressure applied directly to the varistor 51*by* the eccentric 30 to perform a protection. When the rocking bar 31 is rotated by the user, when the eccentric wheel 320 on the upper rocker arm and the eccentric wheel 330 on the lower rocker arm rotate to the left, the reed 7 is subjected to a small pressure, and the resistance value of the varistor is large. When it is rotated to the right, the reed 7 is subjected to a large pressure, and the resistance value of the varistor is small. The above-mentioned embodiments are merely illustrative of several embodiments of the present disclosure, and the description thereof is more specific and detailed, but is not to be construed as limiting the scope of the present disclosure. It should be noted that variations and modifications may be made by those skilled in the art without departing from the spirit and scope of the present disclosure. Therefore, the scope of the present disclosure should be determined by the appended claims.

What is claimed is:

1. A varistor type multi-directional input device, comprising a base, an upper cover, wherein an opening is provided on an upper surface of the upper cover, and the upper cover is disposed on the base to form a central cavity;

a rocker assembly, wherein the rocker assembly is mounted in the central cavity, comprising a rocking bar, an upper rocker arm, and a lower rocker arm; the upper rocker arm and the lower rocker arm are arranged in an upper and lower cross; the upper rocker arm is in a shape of an arch, the upper rocker arm comprises a first convex portion formed by a central upward convex, a first shaft end and a second shaft end disposed at two sides of the first convex portion, and a first through hole at a center of the first convex portion; the lower rocker arm comprises a second convex portion formed by a central upward convex, a third shaft end and a fourth shaft end disposed at two sides of the second convex portion, and a second through hole at a center of the second convex portion; the upper rocker arm and the lower rocker arm are respectively provided with an eccentric wheel; the rocking bar comprises an upper end, and a lower end, the lower end is riveted with the lower rocker arm, protrudes from the second through hole of the lower rocker arm and passes through the first through hole of the upper rocker arm, extends to pass through the opening of the upper cover, and the eccentric wheels of the upper rocker arm and the lower rocker arm are driven by the rocking bar to swing;

a reset assembly, wherein the reset assembly is mounted under the rocker assembly for resetting the rocker assembly after the rocker assembly is pressed;

an electrical component, wherein the electrical component controls a change in resistance, and is configured for converting a motion signal of the rocker assembly into an electrical signal; the electrical component comprises a varistor, an on-off switch; the on-off switch comprises a switch guide core and a conductive elastic piece; and a terminal assembly configured to output the electrical signal, comprising a varistor terminal and a switch terminal, wherein the varistor terminal is mounted on an outside of the varistor, and the switch terminal is mounted on an outside of the switch guide core; the switch guide core is pressed by the eccentric wheels of the upper rocker arm or the lower rocker arm when the rocking bar is pressed, to connect and disconnect the conductive elastic piece and the switch terminal.

2. The varistor type multi-directional input device according to claim 1, wherein the upper rocker arm and the lower rocker arm are arranged in a cross shape.

3. The varistor type multidirectional input device according to claim 2, wherein the varistor is a thin film resistor.

4. The varistor type multi-directional input device according to claim 3, wherein the rocker assembly comprises a rocker arm seat; the rocker arm seat is provided with a rocker arm seat receiving groove corresponding to the second shaft end of the upper rocker arm and the fourth shaft end of the lower rocker arm; the base is provided with a base receiving groove corresponding to the first shaft end of the upper rocker arm and the third shaft end of the lower rocker arm; the rocker arm seat and the base are arranged in a staggered manner, and a first chamber of the rocking bar and the reset assembly is formed in the middle, and the rocker arm seat and the base are respectively provided with a plurality of second chambers matching with the eccentric wheels; the switch guide core and the conductive elastic piece are placed in the second chamber, and an end of the rocking bar is an inverted frustum cone.

5. The varistor type multi-directional input device according to claim 3, wherein the base is provided with a second base receiving groove corresponding to the first shaft end and the second shaft end of the upper rocker arm and the third shaft end and the fourth shaft end of the lower rocker arm; a first base receiving chamber matching with a lower end portion of the lower rocker arm and a second base receiving chamber matching with the eccentric wheels of the upper locker arm and lower rocker arm are provided at a center of the base; the switch guide core and the conductive elastic piece are placed in the first base receiving chamber, the lower end of the lower rocker arm is spherical, the lower rocker arm is in contact with the reset assembly; and an elastic member is placed in the second base receiving chamber, a lower part of the second base receiving chamber is in contact with the varistor.

6. The varistor type multi-directional input device according to claim 5, wherein the base is provided with the switch terminal, a lower bottom plate is disposed under the base, and the varistor terminal is arranged on the lower bottom plate; the lower bottom plate is snapped or screwed or riveted or pin fastened to the base.

7. The varistor type multi-directional input device according to claim 1, wherein the eccentric wheels are cam blocks integrally formed with the upper rocker arm and the lower rocker arm.

8. The varistor type multi-directional input device according to claim 1, wherein the reset assembly comprises a reset ring and a spring.

9. The varistor type multi-directional input device according to claim 5, wherein the elastic member is a reed, and the reed is disposed between the eccentric wheels and the varistor.

10. The varistor type multi-directional input device according to claim 5, wherein the elastic member is a combination of a trigger piece and a spring.

* * * * *